US007938303B2

(12) United States Patent
Tamura et al.

(10) Patent No.: US 7,938,303 B2
(45) Date of Patent: May 10, 2011

(54) GAS COMBUSTION-TYPE DRIVING TOOL

(75) Inventors: Junichi Tamura, Tokyo (JP); Katsuhiko Murayama, Tokyo (JP); Masakazu Konishi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 92 days.

(21) Appl. No.: 12/440,384

(22) PCT Filed: Sep. 13, 2007

(86) PCT No.: PCT/JP2007/067852
§ 371 (c)(1),
(2), (4) Date: Mar. 6, 2009

(87) PCT Pub. No.: WO2008/035618
PCT Pub. Date: Mar. 27, 2008

(65) Prior Publication Data

US 2010/0176175 A1 Jul. 15, 2010

(30) Foreign Application Priority Data

Sep. 19, 2006 (JP) ..... 2006-252092

(51) Int. Cl.
*B25C 1/08* (2006.01)

(52) U.S. Cl. ..... 227/10; 227/9; 227/135; 227/138

(58) Field of Classification Search ..... 227/10, 227/2, 9, 120
See application file for complete search history.

(56) References Cited

U.S. PATENT DOCUMENTS

| | | | | |
|---|---|---|---|---|
| 4,863,089 | A * | 9/1989 | McCardle et al. | 227/116 |
| 4,905,634 | A * | 3/1990 | Veldman | 123/46 SC |
| 4,942,996 | A * | 7/1990 | Wolfberg et al. | 227/136 |
| 5,191,861 | A * | 3/1993 | Kellerman et al. | 123/46 SC |
| 5,197,646 | A * | 3/1993 | Nikolich | 227/8 |
| 5,558,264 | A * | 9/1996 | Weinstein | 227/10 |
| 6,715,655 | B1 * | 4/2004 | Taylor et al. | 227/8 |
| 7,225,962 | B2 * | 6/2007 | Porth et al. | 227/136 |
| 7,556,182 | B2 * | 7/2009 | Murayama et al. | 227/10 |
| 2003/0034377 | A1 * | 2/2003 | Porth et al. | 227/10 |
| 2006/0186171 | A1 * | 8/2006 | Porth et al. | 227/136 |
| 2008/0314951 | A1 * | 12/2008 | Kosuge et al. | 227/10 |
| 2009/0032564 | A1 * | 2/2009 | Takemura et al. | 227/10 |
| 2009/0057365 | A1 * | 3/2009 | Murayama et al. | 227/10 |

FOREIGN PATENT DOCUMENTS

| | | |
|---|---|---|
| JP | 4-28970 | 3/1992 |
| JP | 5-72380 | 10/1993 |
| JP | 8-252806 | 10/1996 |
| JP | 2005-138231 | 6/2005 |

* cited by examiner

*Primary Examiner* — Brian D Nash
(74) *Attorney, Agent, or Firm* — Drinker Biddle & Reath LLP

(57) ABSTRACT

In a feed piston and cylinder mechanism for feeding a feed claw that engages with and disengages from connected nails accommodated within a magazine to a nose portion, the feed claw is biased in a feeding direction by a bias member and is retracted in a backward direction by high-pressure combustion gas. A valve is provided in a path which guides the high-pressure combustion gas to the feed piston and cylinder mechanism and communicates the path with the atmosphere. The feed piston and cylinder mechanism is controlled by opening/closing the valve.

2 Claims, 9 Drawing Sheets

GAS COMBUSTION-TYPE DRIVING TOOL

TECHNICAL FIELD

The present invention relates to a gas combustion-type driving tool which includes a combustion chamber for explosively burning mixed gas obtained by stirring and mixing combustible gas and the air, a striking piston accommodated within a striking cylinder and impulsively driven within the striking cylinder by an action of the high-pressure combustion gas to the striking piston, a nose portion for guiding a driver coupled to a lower surface side of the striking piston to slide so as to drive out a nail, and a feed piston/cylinder mechanism for reciprocally moving a feed claw, that is disposed beneath the nose portion and engages with and disengages from connected nails accommodated within a magazine, in a forward nail feeding direction for feeding a nail to the nose portion side and in a backward retracting direction.

BACKGROUND ART

Conventionally, in a nailer for driving a nail by ae pressure of combustion gas, since an restoring operation due to a spring of a feed piston operated by the combustion gas is performed earlier than an restoring operation of a driver, there may arise a failure of the restoring operation of the driver due to a fact that a next nail is fed to a nose portion and rubs to the driver. Thus, there is proposed a nailer in which a check valve is provided at a former stage of a feeding mechanism so as to hold a gas pressure of the feed piston/cylinder mechanism, and a moving member interlocked with a contact arm performs the sealing control of the tube (for example, a patent document 1).

Patent Document 1: JP-U-05-072380

According to the nailer of JP-U-05-072380, the pressure of the combustion gas supplied to the feed piston is released by the pushing procedure of the contact arm. Thus, in the case where the nailer separates from a member to be driven due to the reaction at the time of the driving operation, the valve is released, whereby the feed piston can not be held and so the feed piston moves to thereby feed a nail to the nose portion. Therefore, there arise problems that a nail rubs to the driver, so that the driver cannot be surely returned and that a nail can not be correctly fed to the nose portion.

DISCLOSURE OF THE INVENTION

One or more embodiments of the invention provides a gas combustion-type driving tool in which, at the time of driving a feed piston/cylinder mechanism by high-pressure combustion gas to thereby drive a nail within a nose portion into a member to be driven and simultaneously operating the feed piston/cylinder mechanism to feed a new nail within the nose portion, the new nail is fed into the nose portion at the timing where a driver is restored to thereby prevent rubbing of a nail to the driver.

According to the first aspect of the invention, the gas combustion-type driving tool includes: a combustion chamber which explosively burns mixed gas obtained by stirring and mixing combustible gas with air; a striking piston which is impulsively driven by high-pressure combustion gas; a nose portion which slidably guides a driver coupled on a lower surface side of the striking piston to drive out a nail; and a feed piston/cylinder mechanism which feeds a feed claw, engaging with and disengaging from connected nails accommodated within a magazine, to the nose portion side. In the feed piston/cylinder mechanism, the feed claw is biased in a feeding direction by a bias member and retracted in a backward direction by the high-pressure combustion gas. A valve for communicating a path with atmosphere is provided in a path for guiding the high-pressure combustion gas to the feed piston/cylinder mechanism. The feed piston/cylinder mechanism is controlled by opening and closing the valve.

According to the second aspect of the invention, the valve may be configured by an electromagnetic valve. Further, the gas combustion-type driving tool may further includes a detecting portion which detects whether or not the nose portion is pressed against a driven member, a timer, and a control portion which controls opening/closing of the electromagnetic valve. The control portion may close the electromagnetic valve and start a timer to monitor a time when it is determined that the nose portion is pressed against the driven member based on a detection result of the detecting portion. The control portion may open the electromagnetic valve when it is determined that the pressing of the nose portion against the driven member is released and a predetermined time lapses.

According to the first aspect, the contact arm is operated in association with the valve in a manner that when the pressing operation of the contact arm against the driven member is released, the valve is opened to communicate the path, for feeding the high-pressure combustion gas to the feed piston/cylinder mechanism, with the atmosphere to thereby start the nail feeding operation by the feed piston/cylinder mechanism. Thus, the rubbing of a nail to the driver can be surely prevented.

Further, according to the second aspect, the control portion controls the opening/closing of the electromagnetic valve based on the detection result of the detecting portion for detecting the state of the contact arm so that the electromagnetic valve is opened at the timing where the driver is restored to thereby start the nail feeding operation by the feed piston/cylinder mechanism. Thus, since the rubbing of a nail to the driver can be surely prevented and the control is performed electrically, the design freedom of the gas combustion-type driving tool can not be degraded.

Other aspects and advantages of the invention will be apparent from the following description, the drawings and the claims.

BRIEF DESCRIPTION OF THE DRAWINGS

FIG. 3(*b*) is a transversal sectional diagram for explaining the movement of the feed piston and the operation of the holding mechanism of the feed piston/cylinder mechanism.

FIG. 5(*b*) is a longitudinal sectional diagram for explaining the relation between the valve mechanism and the feed piston/cylinder mechanism.

FIG. 6(*b*) is a longitudinal sectional diagram for explaining the relation between the valve mechanism and the feed piston/cylinder mechanism.

DESCRIPTION OF REFERENCE NUMERALS AND SIGNS

Figure 1:
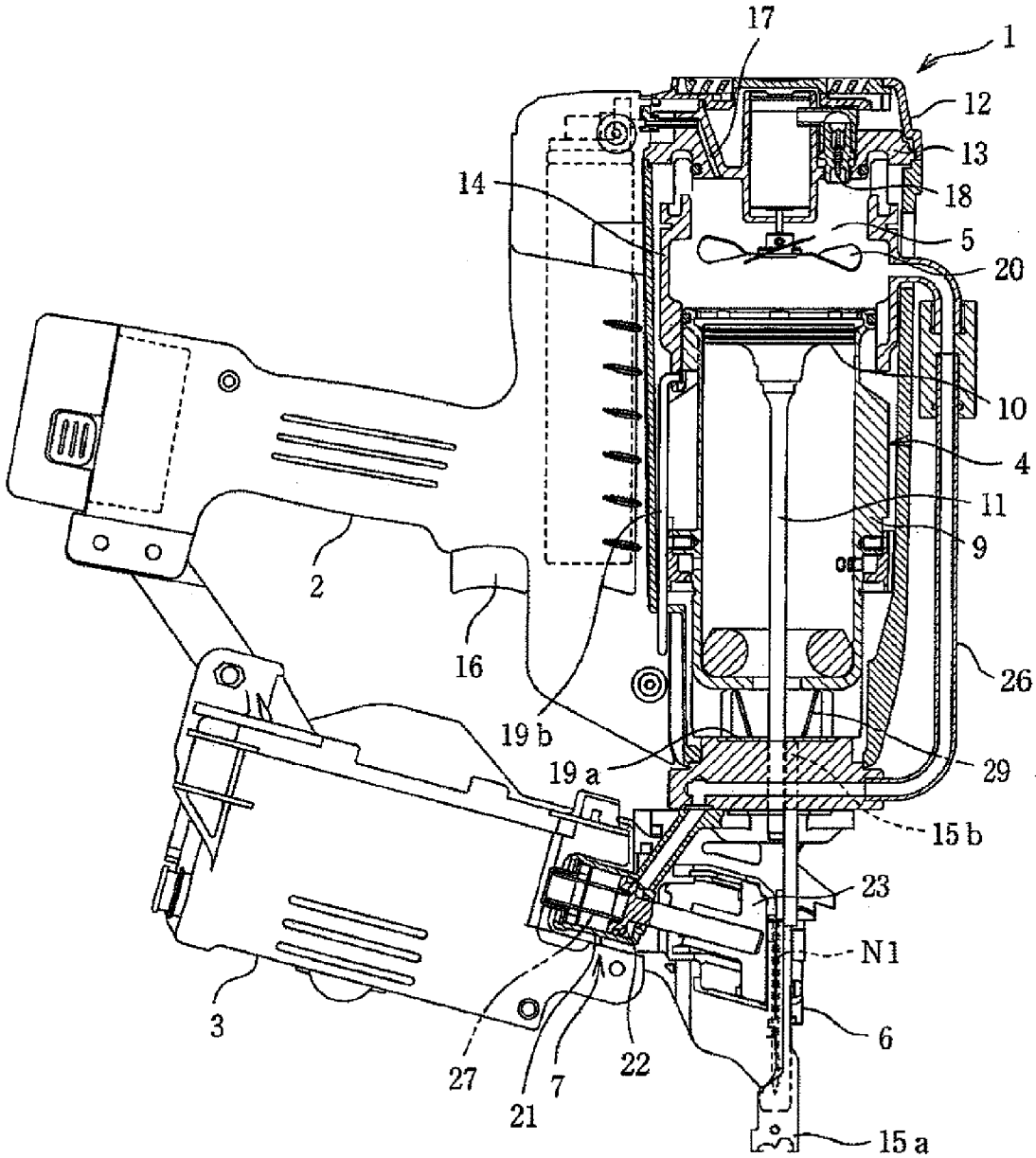
FIG. 1 is a longitudinal sectional diagram showing a side surface of a main portion of a gas combustion-type driving tool according to the invention.

5 combustion chamber
4 striking piston/cylinder mechanism
6 nose portion
7 feed piston/cylinder mechanism
9 striking cylinder
10 striking piston
11 driver
15 contact arm
22 feed piston
23 feed claw
27 bias member
40 valve
A valve mechanism
N nail

BEST MODE FOR CARRYING OUT THE INVENTION

In FIG. 1, a reference numeral 1 depicts a body of a gas combustion-type nailer as a gas combustion-type driving tool. A grip 2 and a magazine 3 are coupled to the body 1 and the body is provided with a striking piston/cylinder mechanism 4, a combustion chamber 5, a nose portion 6 and a feed piston/cylinder mechanism 7.

The striking piston/cylinder mechanism 4 houses a striking piston 10 within a striking cylinder 9 so as to be slidable freely and a driver 11 is integrally coupled at the lower portion of the striking piston 10.

The combustion chamber 5 is formed by an upper end surface of the striking piston 10, the striking cylinder 9, an upper wall (cylinder head) 13 formed within an upper housing 12, and an annular movable sleeve 14 disposed between the piston and the cylinder head. The combustion chamber 5 in a sealed state is formed when the movable sleeve 14 is moved upward, whilst the upper portion of the combustion chamber 5 is communicated with the atmosphere when the movable sleeve is moved downward.

Figure 2:
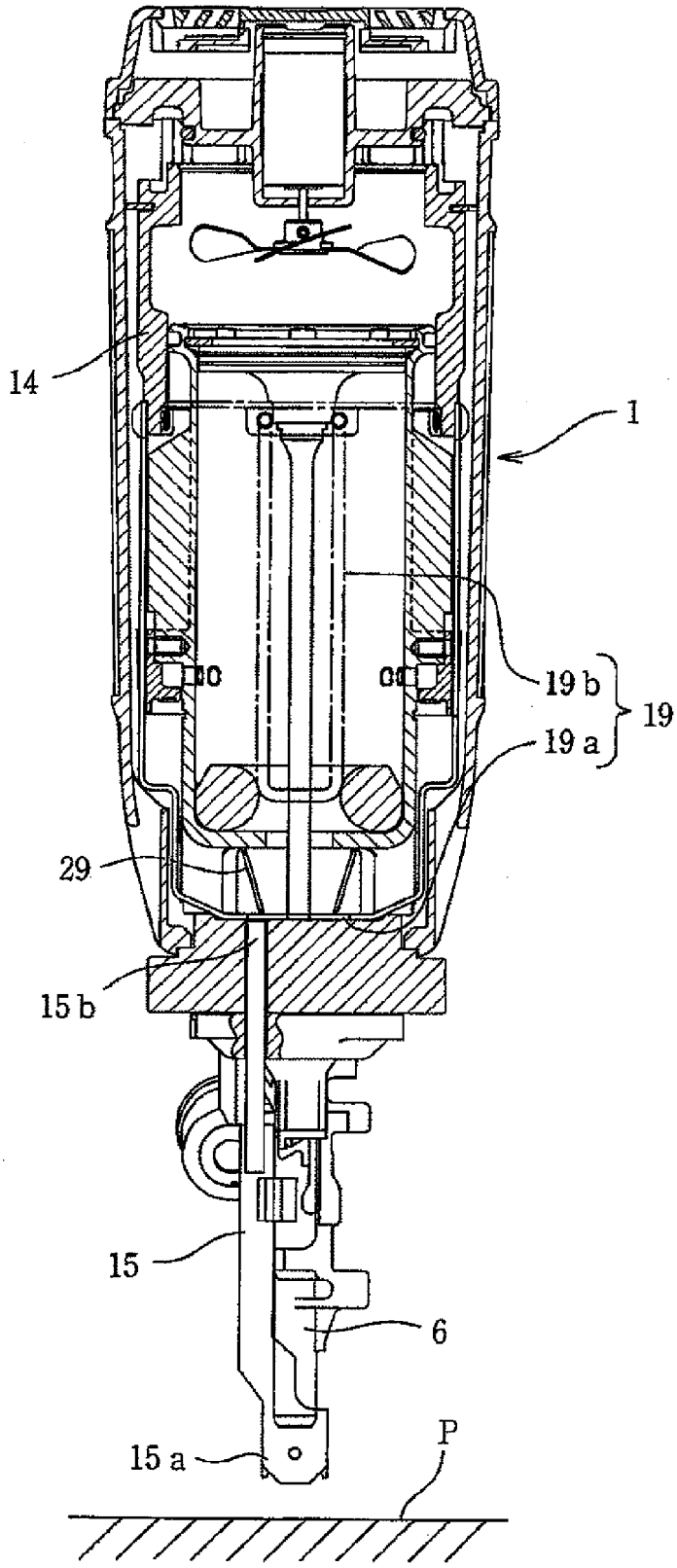
FIG. 2 is a longitudinal sectional diagram showing a front surface of the gas combustion-type driving tool.

The movable sleeve 14 links with a contact arm 15 via a link member 19 as shown in FIG. 2. The link member 19 is configured in a manner that an arm portion 19*b* is extended along the outer periphery of the striking cylinder 9 from the end portion of a basket shaped bottom portion 19*a* disposed beneath the striking cylinder 9. The upper end of the arm portion 19*b* is coupled to the movable sleeve 14. The basket shaped bottom portion 19*a* is biased downward by a spring 29 which, is provided between the lower surface of the striking cylinder 9 and the basket shaped bottom portion.

The contact arm 15 is provided so as to be freely slidable elevationally along the nose portion 6. The tip end 15*a* of the contact arm protrudes from the nose portion 6. The tip end moves upward relatively with respect to the nose portion 6 when the tip end 15*a* is pushed against a driven member P to be driven together with the nose portion 6.

The lower surface of the basket shaped bottom portion 19*a* of the link member 19 engages with the upper end 15*b* of the contact arm 15. Thus, when the nose portion 6 is pushed against the driven member P, the contact arm 15 relatively moves upward to push the link member 19 up against the spring 29 to thereby move the movable sleeve 14 upward. Thus, the combustion chamber 5 is shielded from the atmosphere and so the combustion chamber 5 in the sealed state is formed.

In contrast, when the nailer is lifted up due to the reaction generated immediately after the driving operation, the contact arm 15 moves downward along the nose portion 6 due to its own weight. In contrast, since the combustion chamber 5 just after the nail driving operation is placed in a negative pressure state, when the striking piston 10 moves upward to its original position to thereby release the combustion chamber 5 to the atmosphere, the movable sleeve 14 and the link member 19 relatively move downward by the spring 29 and so engage with the contact arm 15 again as shown in FIGS. 1 and 2.

The upper housing 12 is provided with an injection nozzle 17 communicating with a gas vessel and an injection plug 18 for igniting and burning the mixed gas. Further, the upper housing 12 is provided with a rotary fan 20 for stirring and mixing the combustible gas injected into the combustion chamber 5 and the air to generate the mixed gas of a predetermined air fuel ratio within the chamber.

The nose portion 6 guides the driver 11 so as to perform the sliding operation and is opened for the magazine 3.

Figure 3A:
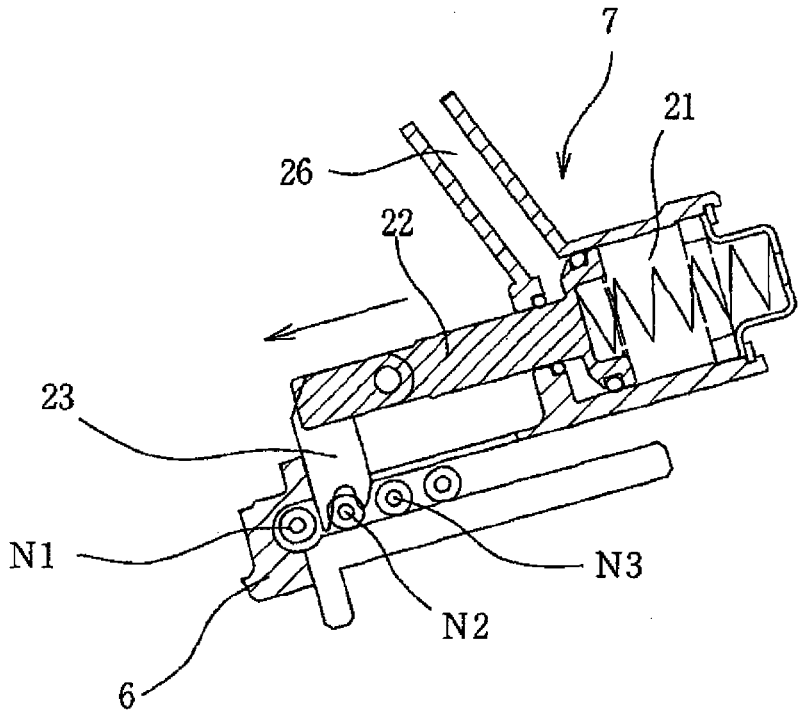
FIG. 3(*a*) is a transversal sectional diagram for explaining a movement of a feed piston and an operation of a holding mechanism of a feed piston/cylinder mechanism.
Figure 3B:
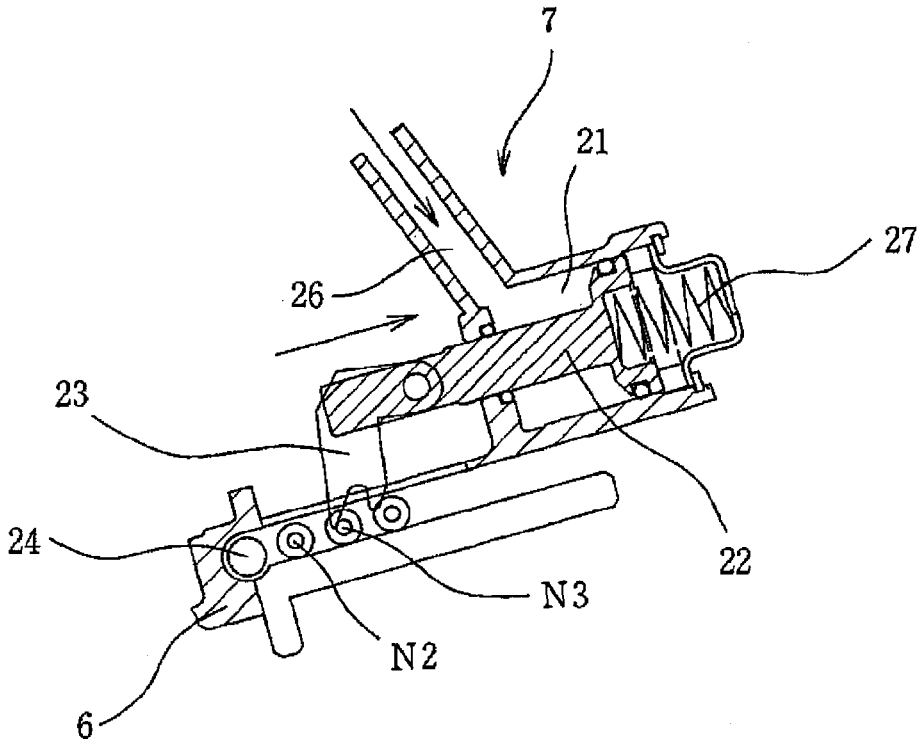

The feed piston/cylinder mechanism 7 includes a feed cylinder 21, a feed piston 22 accommodated within the feed cylinder 21 so as to be slidable freely and a feed claw 23 linked with the tip end of the feed piston 22. The feed piston/cylinder mechanism 7 reciprocally moves in a manner that the feed claw 23 as well as the feed piston 22 are engaged with connected nails N accommodated within the magazine 3 and biased by a spring 27 and so fed in a nail feeding direction so as to be fed on the nose portion 6 side as shown in FIG. 3(*a*) and that the feed claw and the feed piston moves in a direction so as to be retracted from the nose portion 6 against the spring 27 by the high-pressure combustion gas fed via a gas tube 26 as shown in FIG. 3(*b*). The front side of the feed cylinder 21 of the feed piston/cylinder mechanism 7 communicates with the combustion chamber 5 via the gas tube 26 (see FIG. 1). The rear side of the feed cylinder 21 is provided with the spring 27 for always biasing the feed piston 22 in the nail feeding direction. The feed piston 22 moves reciprocally depending on the pressure from the gas tube 26 and the force of the spring 27.

As shown in FIG. 3(*a*), when the feed piston 22 is biased by the spring 27 and moved in the feeding direction, the feed claw 23 engages with the second nail N2 of the connected nails N and pushes a headmost nail N1 into the ejection port 24 of the portion 26.

Further, as shown in FIG. 3(*b*), when the headmost nail N1 is driven out and the feed piston 22 moves in the retracting direction, the feed claw 23 moves backward to a position capable of being engaged with a third nail N3. Thus, when the feed piston 22 is biased by the spring 27 and moves in the forward direction, the second nail N2 is pushed into the ejection port 24 of the nose portion 6.

Figure 4:
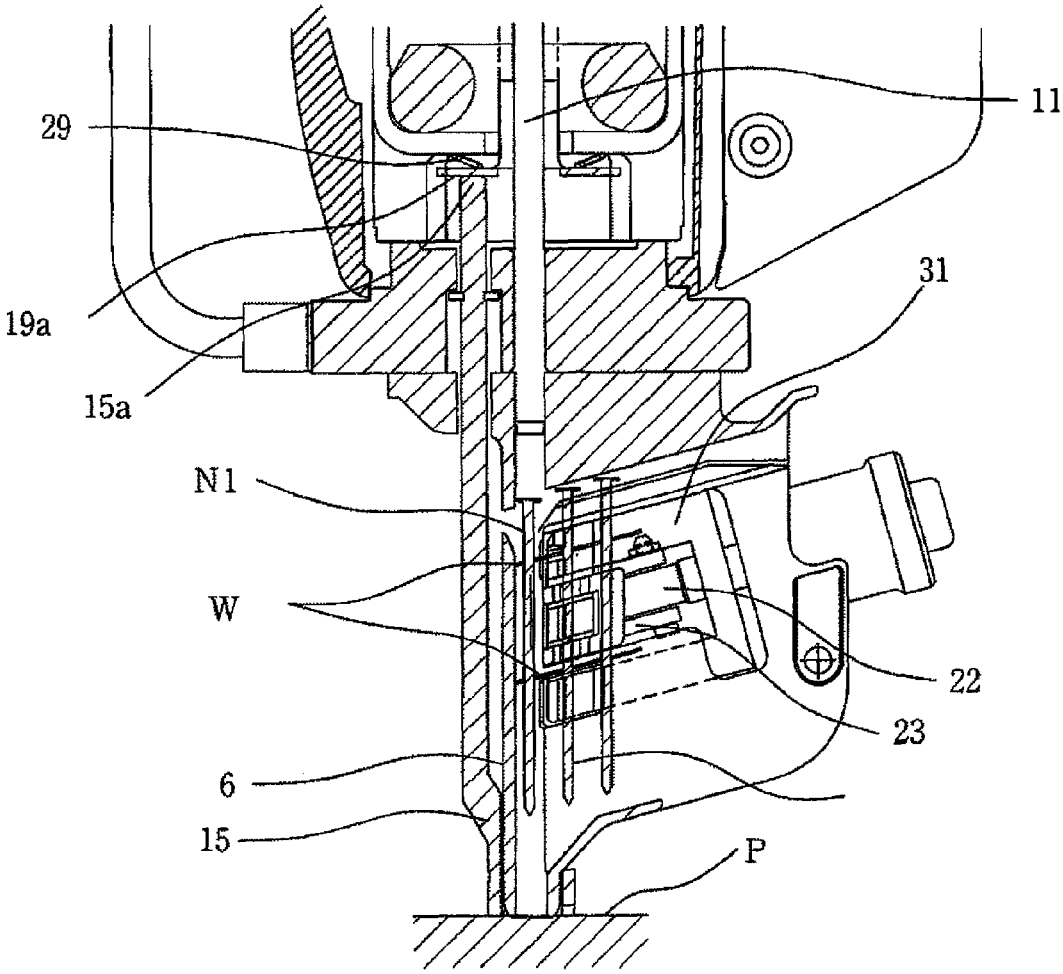
FIG. 4 is a transversal sectional diagram for explaining a state where a contact arm is pressed against a driven member.

At the time of driving a nail, as shown in FIG. 4, the tip end of the nose portion 6 is strongly pushed against the driven member P to relatively move the contact arm 15 upward. As a result, since the lower surface of the basket shaped bottom portion 19*a* of the link member 19 engages with the upper end 15*b* of the contact arm 15, the basket shaped bottom portion 19*a* compresses the spring 29 and moves upward. Thus, the movable sleeve 14 linked with the upper end of the link member 19 moves upward to thereby form the sealed combustion chamber 5. Further, the combustible gas is injected into the combustion chamber 5 from the injection nozzle 17 and stirred and mixed with the air in accordance with the rotation of the rotary fan 20.

Next, when a trigger 16 is pulled, the injection plug 18 ignites the mixed gas, whereby the mixed gas is burnt and explosively expands. The pressure of the combustion gas acts on the upper surface of the striking piston 10 to thereby drive the striking piston 10 downward, so that the driver 11 strikes the headmost nail N1 supplied within the nose portion 6. In this case, when the striking piston 10 is driven by the high-pressure combustion gas generated in the combustion chamber 5, since the combustion gas is also fed to the feed piston/cylinder mechanism 7 via the gas tube 26, the pressure within the feed cylinder 21 increases. Thus, the feed piston 22 moves in the returning direction against the spring 27 to prepare to send a nail to the ejection port 24 in preparation for the next driving (see FIG. 3(*b*)).

When the driving operation of a nail is completed, since the temperature within the combustion chamber 5 reduces abruptly, the combustion gas within the combustion chamber 5 shrinks and so the space of the combustion chamber 5 above the striking piston 10 is placed in a negative pressure state. Thus, the striking piston 10 moves upward together with the driver 11 due to the pressure difference between the atmospheric pressure and the negative pressure. However, since the pressure within the gas tube 26 also reduces when the pressure within the combustion chamber 5 becomes the negative pressure, the feed piston 22 is biased by the spring 27 and moves in the nail feeding direction to thereby feed a nail to the ejection port 24, as shown in FIG. 3(*a*). In this case, depending on the timing where the feed piston 22 is biased by the spring 27 and moves in the nail feeding direction and the timing where the striking piston 10 restores after the completion of the driving operation, when the feed claw 23 feeds a nail to the nose portion 6 before the driver 11 returns from the nose portion 6, there may arise a case that the nail rubs to the driver 11 moving upward within the nose portion 6. In order to avoid such a phenomenon, the pressure within the feed cylinder 21 is maintained so as to delay the start of the forward moving (in the nail feeding direction) of the feed piston 22, whereby the feed claw 23 feeds the nail within the nose portion 6 at the timing where the driver 11 returns from the nose portion 6.

Figure 5A:
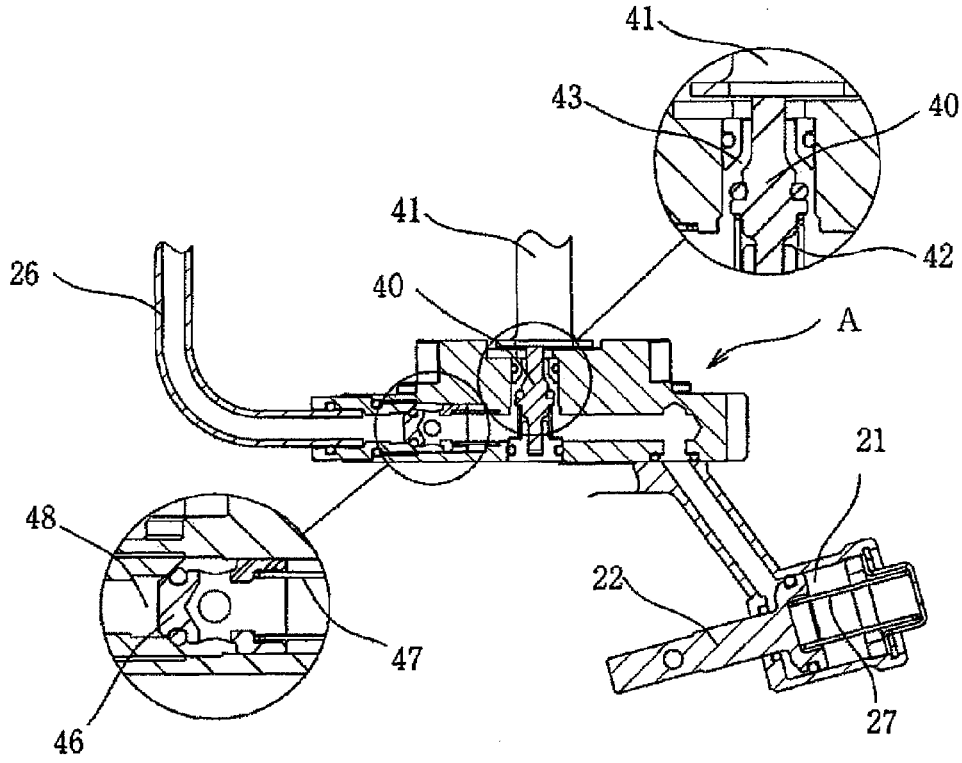
FIG. 5(*a*) is a longitudinal sectional diagram for explaining a relation between a valve mechanism and the feed piston/cylinder mechanism.
Figure 5B:
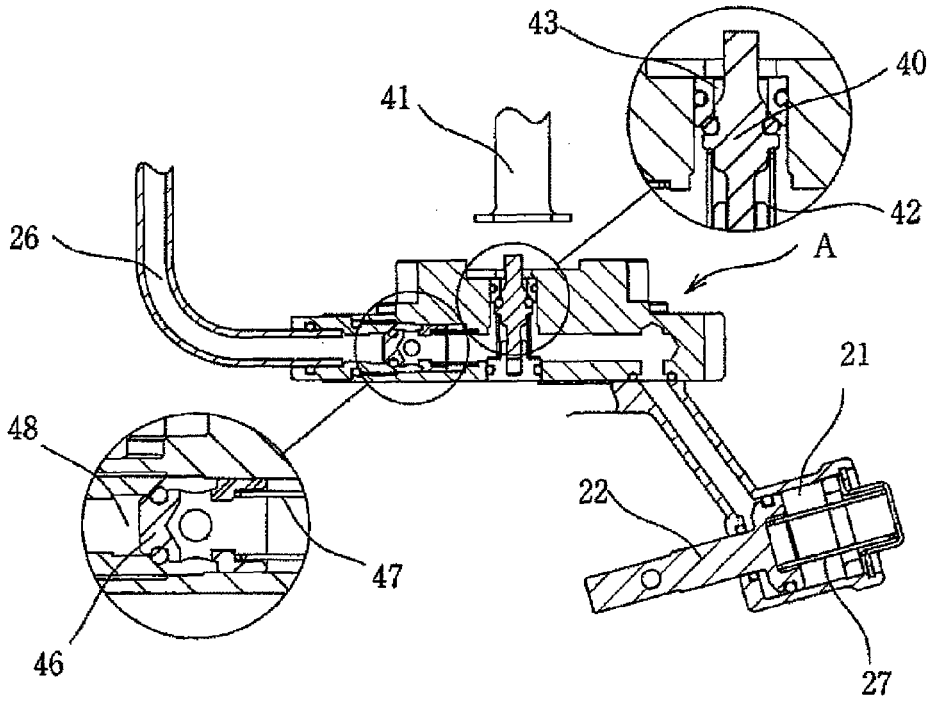

This operation is performed by providing a valve mechanism A, for controlling the operation as to whether or not the combustion gas within the feed cylinder 21 is to be communicated with the atmosphere, on the way of the gas tube 26 as shown in FIG. 5. That is, when the contact arm 15 is not pressed against the driven member P, as shown in FIG. 5(*a*), a valve 40 is pushed by a pressing plate 41 and moves down against a spring 42 to open a path 43 for communicating the feed cylinder 21 with the atmosphere to thereby communicate the feed cylinder 21 to the atmosphere. When the contact arm 15 is pressed against the driven member, as shown in FIG. 5(*b*), since the pressing plate 41 moves upward to release the pressing operation against the valve 40, the valve 40 is biased by the spring 42 and moves upward to close the path 43 to thereby shuts off the feed cylinder 21 from the atmosphere.

Figure 7:
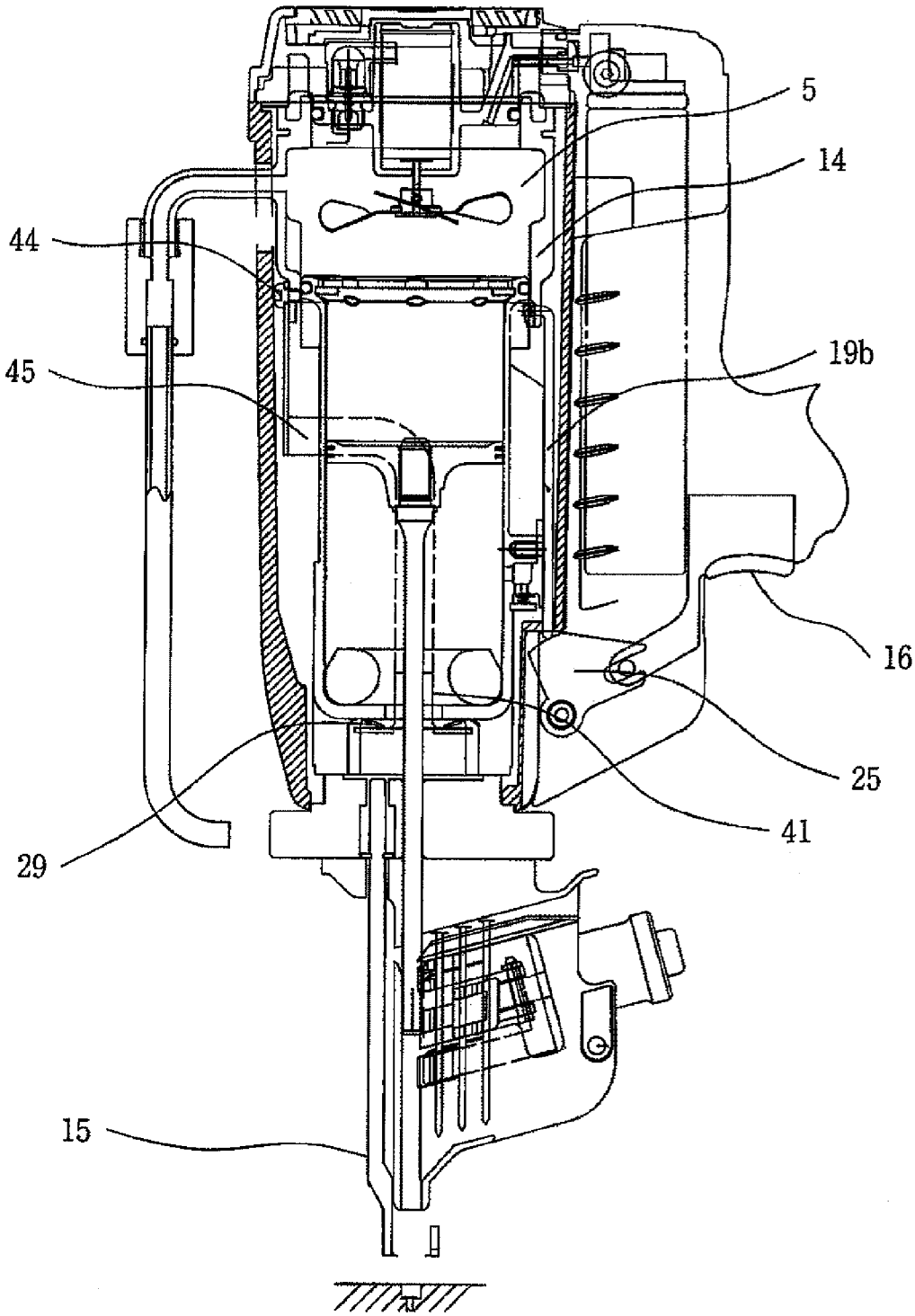
FIG. 7 is a longitudinal sectional diagram of the gas combustion-type driving tool for explaining a structure of a control plate for controlling the valve mechanism.

As shown in FIG. 7, the pressing plate 41 is integrally formed with the lower end of a link 45 which upper end is fixed to the movable sleeve 14 via screws 44. When the contact arm 15 is pressed against the driven member and moves upward, the movable sleeve 14 is pushed up by the contact arm 15 and moves upward, whereby the link 45 also moves upward integrally with the movable sleeve and so the pressing plate 41 moves upward to release the pressing operation against the valve 40 (see FIG. 5(*b*)). When the driving operation of a nail is completed to release the pressing operation of the contact arm 15, the movable sleeve 14 moves downward, whereby the link 45 also moves downward integrally with the movable sleeve 14 and the pressing plate 41 presses the valve 40 (see FIG. 5(*a*)).

Further, the valve mechanism A is provided with an one-way valve 46 at a portion where the combustion gas flows into the valve mechanism A from the gas tube 26. The one-way valve 46 is always biased by a spring 47 so as to close the gas inlet 48. However, when the mixed gas is burnt within the combustion chamber 5, the burnt high-pressure combustion gas pushes back the one-way valve 46 against the spring 47, whereby the combustion gas flows into the feed cylinder 21 via the gas inlet 48 (see FIG. 6(*a*)). Then, when the pressure within the feed cylinder 21 becomes equal to that within the gas tube 26, the one-way valve 46 is biased by the spring 47 to close the gas inlet 48 to thereby form a space within which the high-pressure combustion gas is filled (see FIG. 6(*b*)).

According to the aforesaid gas combustion-type driving tool, the pressing operation of the pressing plate 41 against the valve 40 is released when the contact arm 15 is pressed against the driven member, whereby the valve 40 closes the path 43 as shown in FIG. 5(*b*). Then, the combustible gas is injected into the combustion chamber 5 from the injection nozzle 17 and the rotary fan 20 rotates to stir and mix the combustible gas with the air. In this state, when the trigger 16 is pulled, the mixed gas explosively burns within the combustion chamber 5 and the burnt high-pressure combustion gas acts on the striking piston 10 to drive the striking piston to thereby drive a nail into the driven member. Simultaneously, the high-pressure combustion gas is fed to the valve mechanism A via the gas tube 26.

Figure 6A:
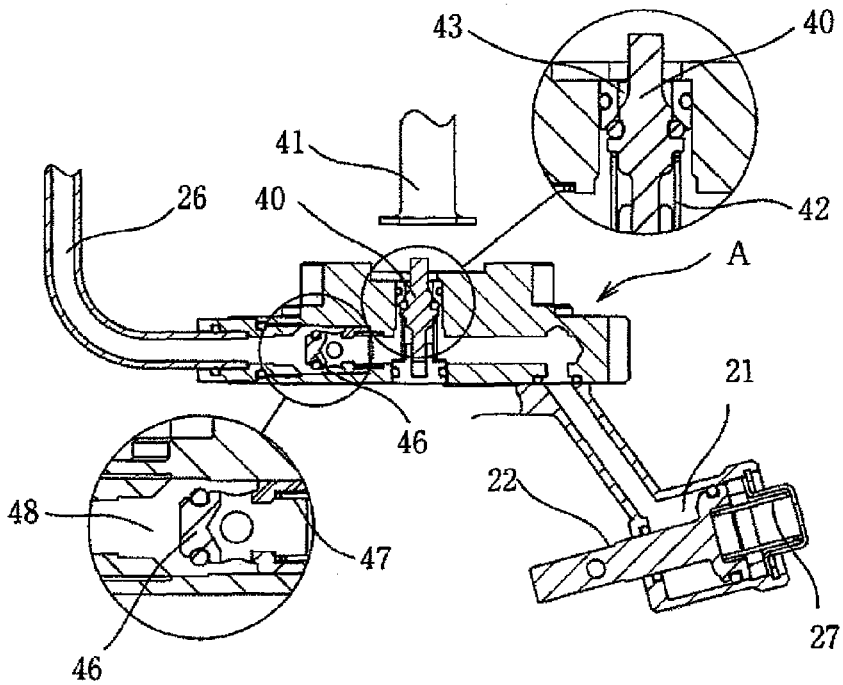
FIG. 6(*a*) is a longitudinal sectional diagram for explaining the relation between the valve mechanism and the feed piston/cylinder mechanism.
Figure 6B:
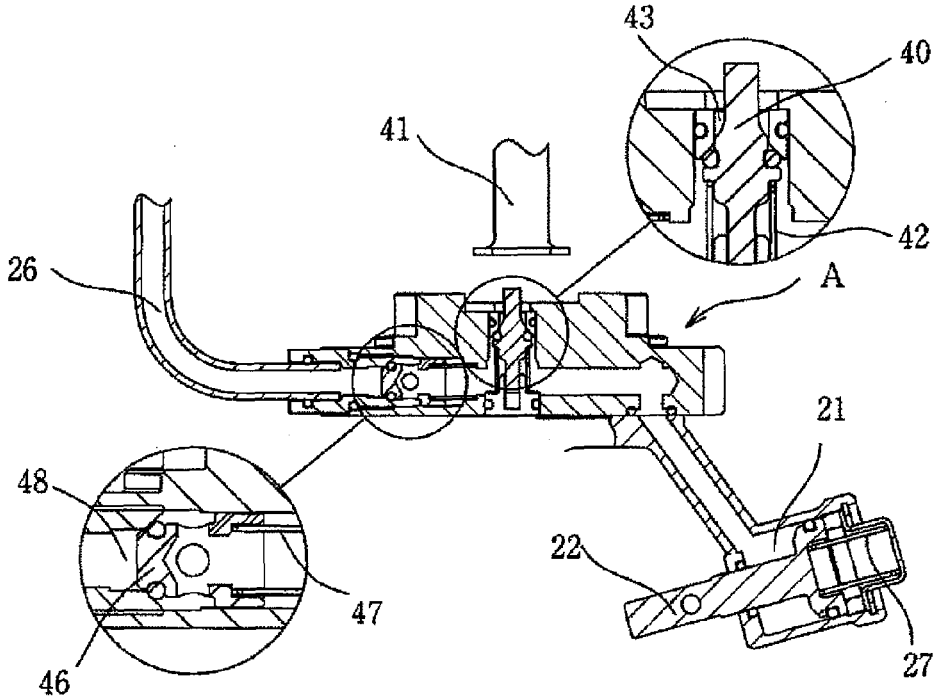

The high-pressure combustion gas fed to the valve mechanism A pushes back the one-way valve 46 against the spring 47 to open the gas inlet 48 and also flows into the feed cylinder 21 to retract the feed piston 22 against the spring 27 (see FIG. 6(*a*)). When the pressure within the feed cylinder 21 becomes equal to that of the gas tube 26, as shown in FIG. 6(*b*), the one-way valve 46 is biased by the spring 27 and moves in the forward direction to close the gas inlet 48. Thus, the pressure within the feed cylinder 21 is kept in a high-pressure state even if the pressure within the combustion chamber 5 reduces, the retracting state of the feed piston 22 is maintained and so the feeding operation of a nail by the feed claw 23 is prevented.

When the driving operation of a nail is completed, the pressing operation of the contact arm 15 is released and the movable sleeve 14 moves downward. Then, the link 45 also moved down integrally with the movable sleeve 14. Thus, as shown in FIG. 6(*a*), since the pressing plate 41 presses the valve 40, the valve 40 moves down against the spring 42 to open the path 43 to thereby communicate the feed cylinder 21 with the atmosphere. As a result, since the pressure within the feed cylinder 21 reduces to the pressure same as the atmospheric pressure, the feed piston 22 biased by the spring 27 moves in the nail feeding direction to thereby feed the nail into the ejection port 24.

As explained above, at the time of driving a nail by the driver 11, the high-pressure combustion gas for driving the driver 11 is fed to the cylinder via the gas tube 26 to retract the feed piston 22 to thereby prepare to send a nail to the ejection port 24 in preparation for the next driving. In this case, since the nail is fed to the ejection port at a stage where the driving operation of a nail is completed and the contact arm 15 separates from the driven member, the timing for feeding the nail to the ejection port 24 coincides with the timing where the driver 11 returns from the nose portion 6. Thus, the gas combustion-type driving tool can be realized which can avoid the occurrence of a trouble that a nail fed to the nose portion 6 rubs to the driver 11 moving up within the nose portion 6.

That is, as shown in FIG. 7, when the pushing operation of the arm portion 19*b* by the member 25 is canceled or the combustion chamber 5 is opened to the atmosphere in response to the release of the trigger 16 by an operator, since the striking piston 10 moves up, the feeding operation of a nail to the ejection port 24 is performed at this timing in association with the moving-up operation.

Although the valve mechanism A is configured in a manner that the valve 40 is controlled mechanically in association with the movable sleeve 14, the valve mechanism may be configured in a manner that the valve 40 is formed by an electromagnetic valve 50 which is electrically controlled.

Figure 8:
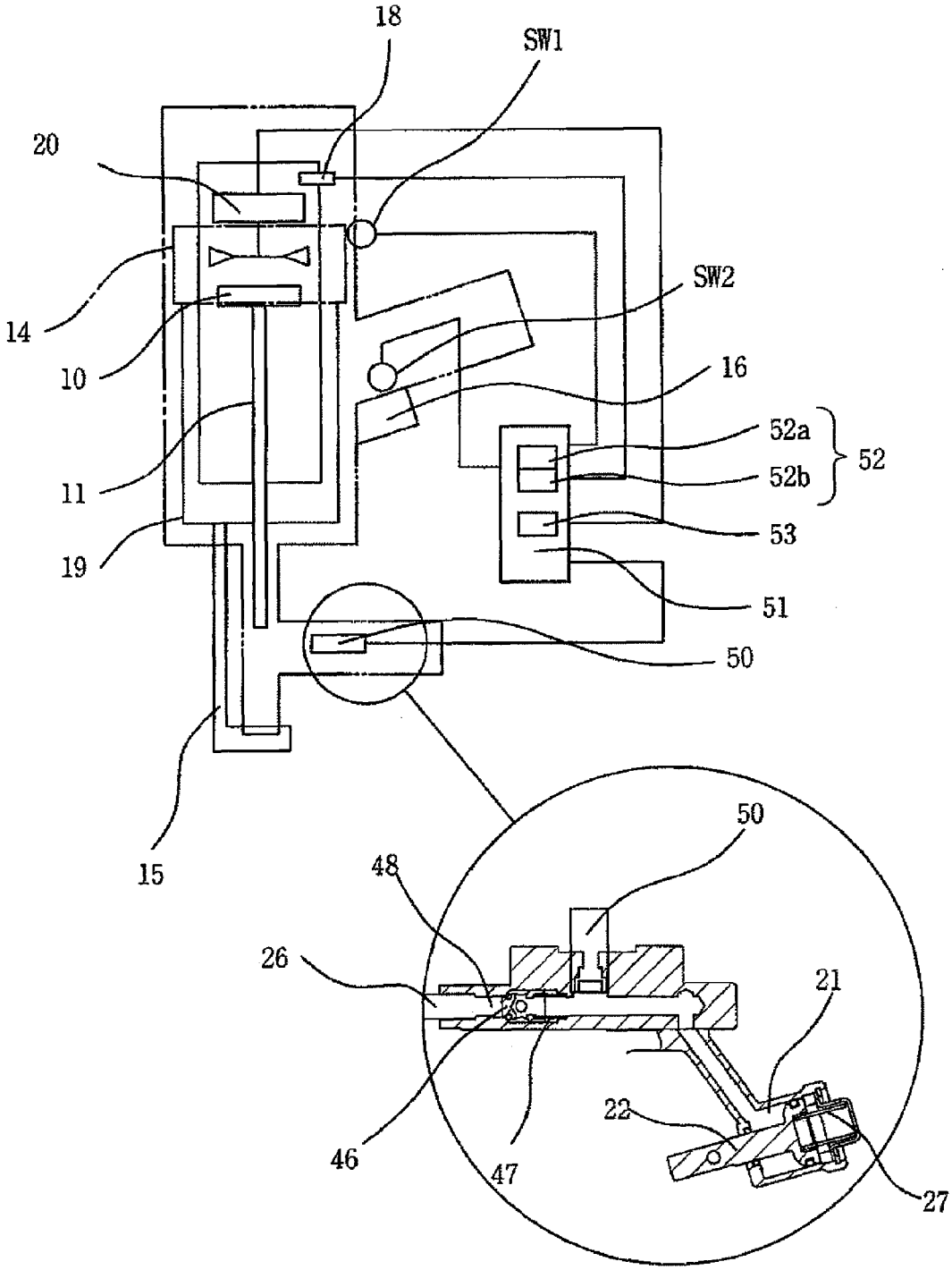
FIG. 8 is a schematic diagram for explaining an electrical structure of the gas combustion-type driving tool.

FIG. 8 is a schematic diagram showing the electric configuration of the gas combustion-type driving tool. The gas combustion-type driving tool is configured by a contact switch SW1 which is turned on/off in accordance with the elevational movement of the movable sleeve 14 (opening/closing of the combustion chamber), a trigger switch SW2 which is turned on when the trigger 26 is pulled, and a control portion 51 which controls the rotation of the rotary fan 20, the ignition of the injection plug 18 and the on/off state of the electromagnetic valve 50 in accordance with the states of these two switches.

The control portion may be configured by an MPU provided with a timer function 52 and an internal memory 53. The MPU determines the states of the contact switch SW1 and the trigger switch SW2 and the operation time of the timer function 52 to control the rotary fan 20, the injection plug 18 and the electromagnetic valve 50 based on a control program stored in the internal memory 53.

Figure 9:
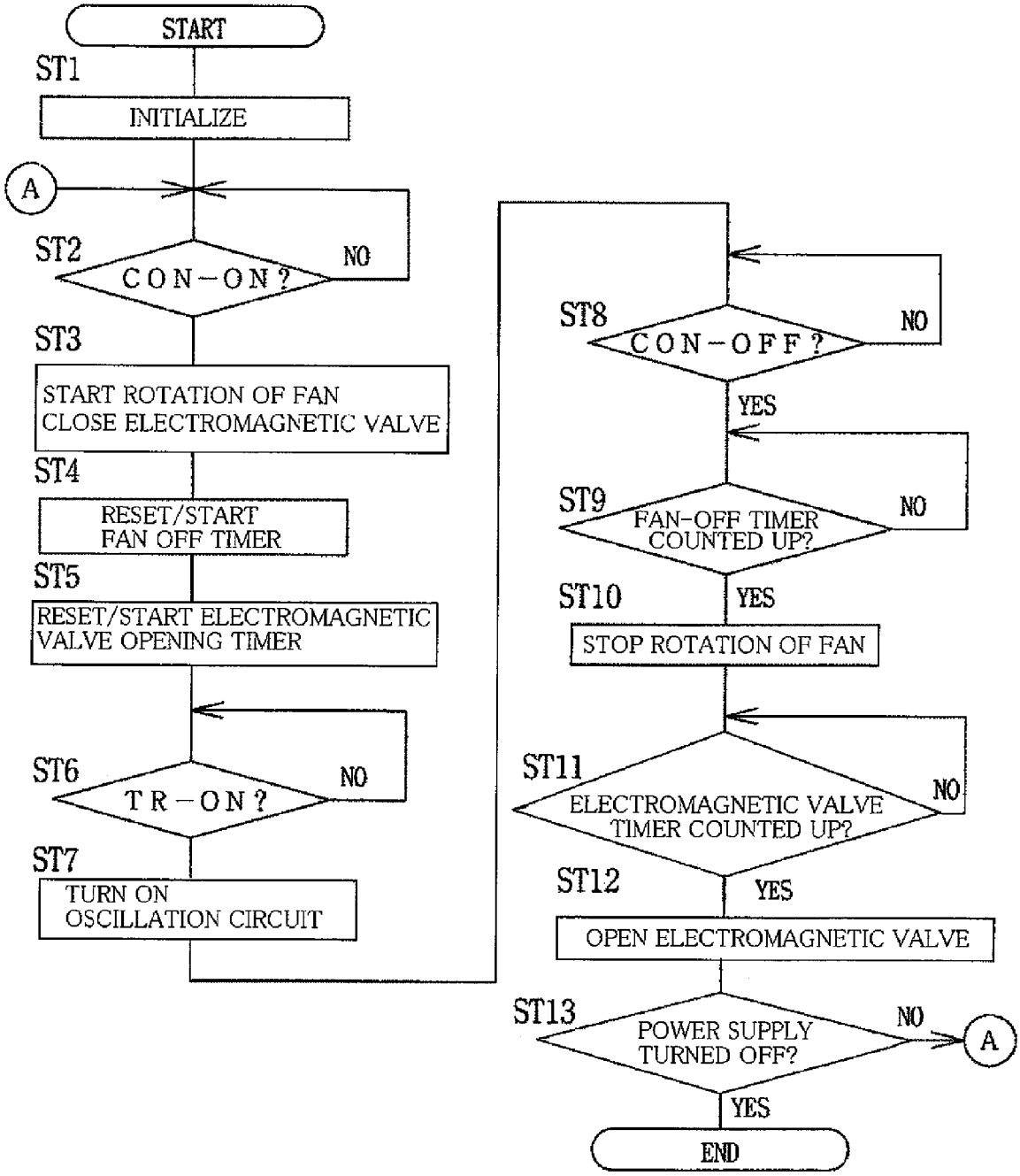
FIG. 9 is a flowchart for explaining an opening/closing of an electromagnetic valve of the valve mechanism.

Next, an example of the control of the valve mechanism A using the electromagnetic valve 50 will be explained based on a flowchart shown in FIG. 9.

When an operator turns on a power supply in order to use the gas combustion-type driving tool, the initializing is performed to thereby set the tool in an initial state (step ST1). The control portion 51 determines in accordance with the output of the contact switch SW1 as to whether or not a user prepared the nail driving operation by pressing the contact arm 15 against the driven member (step ST2). When the contact arm 15 is pressed against the driven member, the movable sleeve 14 moves up to turn the contact switch SW1 on. Then, the process proceeds to a step ST3, whereat the control portion 51 rotates the rotary fan 20, closes the electromagnetic valve 50 and restarts a timer 52*a* for turning the fan off (step ST4). Further, the control portion also restarts a timer 52*b* for opening the electromagnetic valve (step ST5) and waits for the pulling of the trigger 16 (step ST6).

When the trigger 16 is pulled, the trigger switch SW2 is turned on and an oscillation circuit is turned on (step ST7). Then, since the ignition plug is ignited to fire the mixed gas, the mixed gas is explosively burnt to generate high-pressure combustion gas. The high-pressure combustion gas drives the striking piston 10, whereby the driver 11 drives a nail within the ejection port 24 into the driven member. Simultaneously, the high-pressure combustion gas fed into the valve mechanism A pushes back the one-way valve 46 against the spring 47 to open the gas inlet 48. Further, the combustion gas flows within the feed cylinder 21 to retract the feed piston 22 against the spring 27.

When the pressure within the feed cylinder 21 becomes equal to that within the gas tube 26, the one-way valve 46 is biased by the spring 47 to close the gas inlet 48. Thus, even if the pressure within the combustion chamber reduces, the pressure within the feed cylinder 21 is kept in the high-pressure state. As a result, the feed piston 22 maintains the retracting state, whereby the nail feeding operation to the nose portion 6 by the feed claw 23 is not performed.

When the nail driving operation is completed and the movable sleeve 14 moves down, the contact switch SW1 is turned off (step ST8). Then, the timer 52*a* for turning off the fan is checked (step ST9). When the timer counts up its count value, the process proceeds to a step ST10, whereat the rotation of the rotary fan 20 is stopped and the timer 52*b* for opening the electromagnetic valve is checked (step ST11). When this timer counts up its count value, the process proceeds to a step ST12 to open the electromagnetic valve 50.

When the electromagnetic valve 50 is opened, since the feed cylinder 21 communicates with the atmosphere, the pressure within the feed cylinder 21 reduces to the pressure of the atmosphere. Thus, the feed piston 22 is biased by the spring 27 and moves in the nail feeding direction, whereby a nail can be fed within the ejection port 24.

In the case of continuing the nail driving operation after opening the electromagnetic valve 50 in the step ST12, since the power supply is kept in the on state (step ST13), the process returns to the step ST2 and waits for the start of the next nail driving operation (the pressing of the contact arm 15 against the driven member).

As explained above, since the electromagnetic valve 50 is closed before driving a nail and then the electromagnetic valve 50 is opened to start the nail feeding operation by the feed piston 22 after the completion of the driving operation, the gas combustion-type driving tool can be realized which can avoid the occurrence of the trouble that a nail rubs to the driver 11 in the moving-up state.

Although the electromagnetic valve 50 is closed/opened in association with the on/off state of the contact switch, the electromagnetic valve 50 may be always closed. In the latter case, the tool may be configured in the following manner. That is, when a nail is driven into the driven member by the high-pressure combustion gas generated by the burning of the mixed gas, simultaneously the mixed gas is fed to the feed cylinder 21 via the gas tube 26 to thereby move the feed piston 22 in the retracting direction against the spring 27. At this time, the movement in the retracting direction is detected by a not-shown switch, and then the electromagnetic valve 50 is opened upon the lapse of a predetermined time period after the movement of the feed piston 22 in the retracting direction to thereby reduce the pressure within the feed cylinder 21, whereby the feed piston 22 is biased by the spring 27 and moved in the feeding direction.

Although the invention is explained in detail with reference to the specific exemplary embodiment, it will be apparent for those skilled in the art that various changes and modifications may be made without departing from the gist and scope of the invention.

The present application is based on Japanese Patent Application (Japanese Patent Application No. 2006-252092) filed on Sep. 19, 2006, the content of which is incorporated herein by reference.

INDUSTRIAL APPLICABILITY

The invention can be applied to the gas combustion-type driving tool including the feed piston/cylinder mechanism which reciprocally moves the feed claw, that engages with and disengages from the connected nails accommodated within the magazine, to the nail feeding direction for feeding the feed claw forwardly on the nose portion side and in the retracting direction on the backward side.

The invention claimed is:

1. A gas combustion-type driving tool, comprising:

a combustion chamber that explosively burns mixed gas obtained by stirring and mixing combustible gas with air;

a striking piston that is impulsively driven by high-pressure combustion gas;

a nose portion that slidably guides a driver coupled to a lower surface side of the striking piston to drive out a nail;

a feed piston and cylinder mechanism that feeds a feed claw to the nose portion side, the feeding claw engaging with and disengaging from connected nails accommodated within a magazine; and a valve that is provided in a path for guiding the high-pressure combustion gas to the feed piston and cylinder mechanism and that communicates the path with atmosphere, wherein the feed piston and cylinder mechanism includes a feed cylinder and a feed piston accommodated within the feed cylinder;

wherein the feed claw is connected to the feed piston;

wherein, in the feed piston and cylinder mechanism, the feed claw is biased in a feeding direction by a bias member, wherein the feed piston and cylinder mechanism is configured such that the feed piston moves in a returning direction against the bias member by flowing the high-pressure combustion gas into the feed piston and cylinder mechanism, and the feed piston biased by the bias member moves in the feeding direction to feed a nail by actuating the valve to communicate the feed cylinder with the atmosphere.

2. A gas combustion-type driving tool, comprising:

a combustion chamber that explosively burns mixed gas obtained by stirring and mixing combustible gas with air;

a striking piston that is impulsively driven by high-pressure combustion gas;

a nose portion that slidably guides a driver coupled to a lower surface side of the striking piston to drive out a nail;

a feed piston and cylinder mechanism that feeds a feed claw to the nose portion side, the feeding claw engaging with and disengaging from connected nails accommodated within a magazine;

an electromagnetic valve that is provided in a path for guiding the high-pressure combustion as to the feed piston and cylinder mechanism and that communicates the path with atmosphere;

a detecting portion that detects whether or not the nose portion is pressed against a driven member;

a timer; and a control portion that controls opening/closing of the electromagnetic valve, wherein, in the feed piston and cylinder mechanism, the feed claw is biased in a feeding direction by a bias member and retracted in a backward direction by the high-pressure combustion gas, wherein the feed piston and cylinder mechanism is controlled by opening and closing the valve, wherein the control portion closes the electromagnetic valve and starts the timer to monitor a time when it is determined that the nose portion is pressed against the driven member based on a detection result of the detecting portion, and wherein the control portion opens the electromagnetic valve when it is determined that the pressing of the nose portion against the driven member is released and a predetermined time lapses.

* * * * *